US009784218B1

(12) United States Patent
Waisanen

(10) Patent No.: US 9,784,218 B1
(45) Date of Patent: Oct. 10, 2017

(54) SOUND ATTENUATING AIR INTAKE SYSTEMS FOR MARINE ENGINES

(71) Applicant: Brunswick Corporation, Lake Forest, IL (US)

(72) Inventor: Andrew S. Waisanen, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/172,809

(22) Filed: Jun. 3, 2016

(51) Int. Cl.
*F02M 3/12* (2006.01)
*F02M 35/12* (2006.01)
*F02M 3/06* (2006.01)

(52) U.S. Cl.
CPC ..... *F02M 3/06* (2013.01); *F02M 3/12* (2013.01); *F02M 35/12* (2013.01)

(58) Field of Classification Search
CPC ..... F02D 9/02; F02D 9/1055; F02D 11/02; F02D 11/10; F02M 3/05; F02M 3/06; F02M 3/07; F02M 3/08; F02M 3/09; F02M 3/12; F02M 3/075; F02M 35/1272; F02M 35/10144; F02M 35/1211; F02M 35/1216; F02M 35/116; F02M 35/1288; F02M 23/05; F02M 23/067; F02M 7/24; F02M 17/04
USPC ..... 123/337, 339.1, 339.23
See application file for complete search history.

(56) References Cited

U.S. PATENT DOCUMENTS 4,287,962 A * 9/1981 Ingard ..... F01N 1/003 181/224
4,337,742 A 7/1982 Carlson et al.
5,722,367 A 3/1998 Izydorek et al.
5,947,082 A * 9/1999 Choi ..... F02D 9/1055 123/339.1
6,196,187 B1 * 3/2001 Zubeck ..... F02M 35/1216 123/339.1
6,499,473 B2 12/2002 Itoh
6,634,334 B1 * 10/2003 Hwang ..... F02D 9/02 123/337
6,647,956 B1 11/2003 Sharpton
6,834,637 B1 12/2004 Sharpton
7,198,027 B1 * 4/2007 Breznik ..... F02D 9/1055 123/337
8,381,871 B1 * 2/2013 Hellie ..... F02M 35/1238 123/184.53
2002/0162532 A1 * 11/2002 Shaw ..... F02M 35/10144 123/339.1

(Continued)

*Primary Examiner* — Hieu T Vo
*Assistant Examiner* — Arnold Castro
(74) *Attorney, Agent, or Firm* — Andrus Intellectual Property Law, LLP

(57) ABSTRACT

An air intake system for a marine engine has a throttle body and a throttle plate that is rotatably supported within the throttle body. The throttle plate is rotatable to regulate air flow through the throttle body from a first region on a first side of the throttle plate to a second region on a second side of the throttle plate. An air conduit has an air conduit inlet and an air conduit outlet. A noise cancelling device comprises a pass-though chamber. The pass-through chamber has a chamber inlet that receives the air flow from the air conduit, a chamber outlet that discharges the air flow to the idle air control valve, and a pass-through interior between the chamber inlet and chamber outlet. The pass-though chamber is configured to cancel noise emanating from the idle air control valve.

10 Claims, 6 Drawing Sheets

(56) References Cited

U.S. PATENT DOCUMENTS

2005/0229891 A1* 10/2005 Kokubo ..... F02M 35/10052
123/184.57

* cited by examiner

SOUND ATTENUATING AIR INTAKE SYSTEMS FOR MARINE ENGINES

FIELD

The present disclosure generally relates to air induction systems on internal combustion engines for marine drives. The present disclosure more particularly relates to sound attenuating assemblies for reducing noise emanating from an idle air control valve.

BACKGROUND

Internal combustion engines for marine drives often have an idle air control valve that is configured to regulate the flow of air into an intake manifold of the engine when a throttle plate of the engine is either closed or nearly closed. Some examples of idle air control valves are disclosed in U.S. Pat. Nos. 5,722,367 and 4,337,742. Further examples of idle air control valves are described herein below with reference to FIGS. 1-4.

U.S. Pat. No. 6,647,956, which is hereby incorporated herein by reference in entirety, discloses an idle air intake system for a marine drive having a fibrous pad disposed in an air conduit leading to the idle air control valve. The fibrous pad is configured to decrease noise emanating from the idle air control valve.

Through research and development, the present inventor has determined that it is desirable to provide improved noise attenuating systems for marine engines. It is desirable to provide noise attenuating systems that are more modular in configuration and adaptable to a wide variety of intake system configurations. The present inventor has further determined that inclusion of a fibrous pad, such as disclosed in U.S. Pat. No. 6,647,956, can be unduly restrictive to air flow and thus can adversely affect performance of the engine. The fibrous pad also requires a dedicated mounting structure or some other means for retaining the pad within the air flow conduits. This disadvantageously complicates manufacture and adds cost.

The present inventor recognizes that it would be significantly beneficial if an inexpensive device could be provided for reducing the sound level caused both by the operation of the idle air control valve and the air flowing through the conduit associated with the idle air control system. The present disclosure is a result of the present inventor's efforts to overcome these and other drawbacks found in the prior art.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an air intake system for a marine engine comprises a throttle body and a throttle plate that is rotatably supported within the throttle body. The throttle plate is rotatable to regulate air flow through the throttle body from a first region on a first side of the throttle plate to a second region on a second side of the throttle plate. An air conduit has an air conduit inlet and an air conduit outlet. The air conduit outlet is disposed in fluid communication with the second region and the air conduit inlet is disposed in fluid communication with a location which is at a pressure generally equal to pressure within the first region. An idle air control valve is connected in fluid communication with the air conduit and configured to control rate of the air flow from the inlet to the outlet. A noise cancelling device comprises a pass-though chamber. The pass-through chamber has a chamber inlet that receives the air flow from the air conduit, a chamber outlet that discharges the air flow to the valve, and a pass-through interior between the chamber inlet and chamber outlet. The pass-though chamber is configured to cancel noise emanating from the idle air control valve.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

FIGS. 1-4 are taken from the presently incorporated U.S. Pat. No. 6,647,956 and show various types of known idle air control systems. The following description of FIGS. 1-4 is also taken from the incorporated U.S. Pat. No. 6,647,956.

An idle air control (IAC) system is used to stabilize idle speed during cold engine operation and operation of the engine after warm-up operations. Idle speed stabilization is needed because of the effect that engine load changes have on emission output, idle quality, and vehicle drivability. A typical idle air control system uses an engine control module (ECM) that controls an idle air control valve (IACV) which regulates the volume of air bypassed around the closed throttle plate. The engine control module controls the valve by applying various input signals according to a program stored in the memory of the engine control module. The various types of idle air control valves used on automotive engines typically include stepper motor, duty control rotary solenoid, duty control air control valve, and on/off vacuum switching valve systems.

Figure 1:
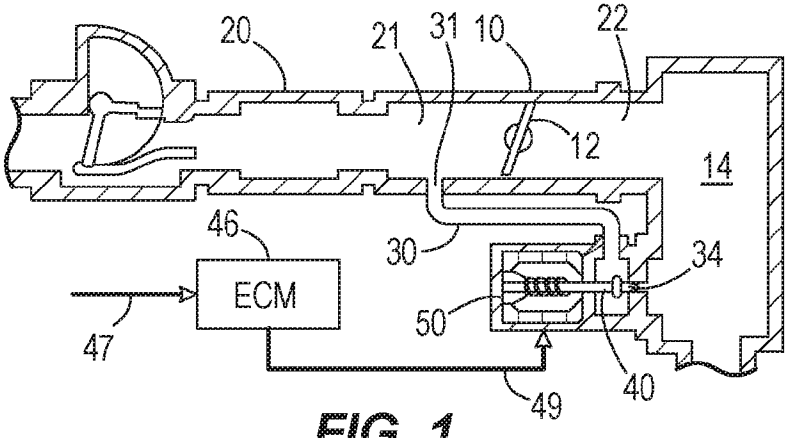
FIG. 1 PRIOR ART

FIG. 1 shows a stepper motor idle air control system. A throttle body 10 is provided with a throttle plate 12 for regulating the flow of air into an air intake chamber 14 and to the engine (not shown in FIG. 1). During normal operation of the engine, air flows through an air intake device 20 from a first region 21 on a first side of the throttle plate 12 to a second region 22 on a second side of the throttle plate 12. An air conduit 30 is provided with an inlet 31 and an outlet 34. The outlet 34 is disposed in fluid communication with the second region 22 and the inlet 31 is disposed in fluid communication with a location which is at a pressure generally equal to the pressure within the first region 21.

Certain embodiments of idle air control systems connect the inlet 31 directly to the throttle body 10 at a location that provides direct flow of air from the first region 21 into the air conduit 30. Alternative embodiments, as will be described below, connect the inlet 31 of the conduit 30 to an alternative location which is at a pressure generally equal to the pressure within the first region 21 or at a pressure which is at least greater than the pressure in the second region 22 during operation of the engine. A valve 40 is connected in fluid communication with the air conduit 30 and configured to control the rate of air flow from the inlet 31 to the outlet 34. In many systems of this type, an engine control module 46 is used to receive signals from various sensors associated with the internal combustion engine, as represented by arrow 47, and provide a control signal as represented by arrow 49, to the actuator 50 of the valve 40. The actuator 50 can be a solenoid or any other appropriate device that causes the valve 40 to selectively move into a blocking or unblocking relationship with the outlet 34.

With continued reference to FIG. 1, the idle air control valve 34 and its actuator 50 comprise a stepper motor, valve 40, and valve seat at the outlet 34 of conduit 30 for the purpose of bypassing the air flow by positioning the valve 40 into one of numerous possible positions. The engine control module 46 controls the valve 40 by sequentially energizing its internal motor coils.

Figure 2:
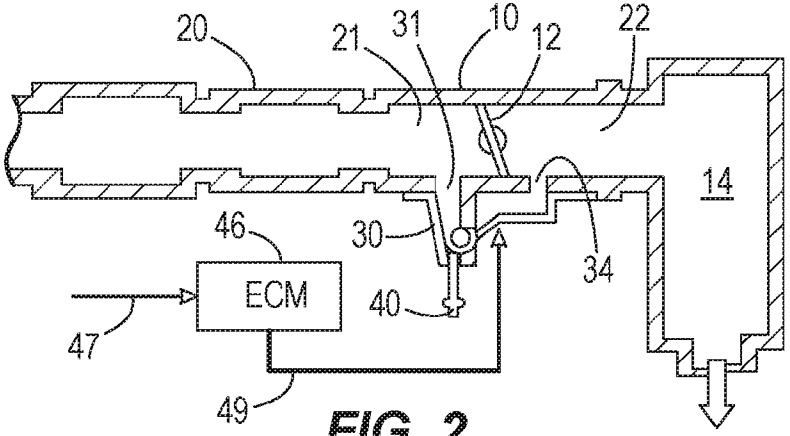
FIG. 2 PRIOR ART
FIGS. 1-4 schematically depict several types of prior art idle air control systems.

FIG. 2 shows a duty-control rotary solenoid idle air control system. Bypass air control is accomplished by means of a movable rotary valve which blocks or exposes a bypass port based on command signals from the engine control module 46. The valve consists of two electrical coils, a permanent magnet, a valve, a bypass port, and a bimetallic coil. The function of the system in FIG. 2 is similar to that of FIG. 1 in that operation of the valve 34 regulates the flow of air through the conduit 30 from the inlet 31 to the outlet 34. This bypasses air around the throttle plate 12 when the throttle plate is in its closed position.

Figure 3:
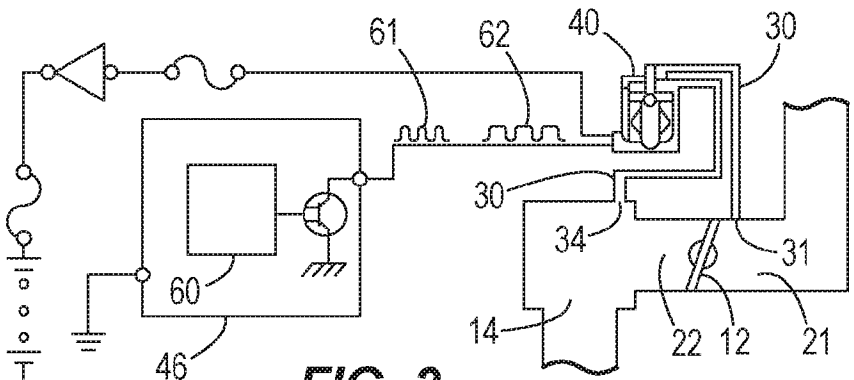
FIG. 3 PRIOR ART

FIG. 3 shows a duty-control air control valve system that bypasses a volume of air around a closed throttle plate 12 by using an engine control module 46 duty cycle which controls the valve system. A microprocessor 60 provides a series of sequential pulses which, by their duty cycle, causes the air control valve to either decrease the bypass air amount, as represented by pulses 61, or increase the bypass air amount, as represented by pulses 62.

Figure 4:
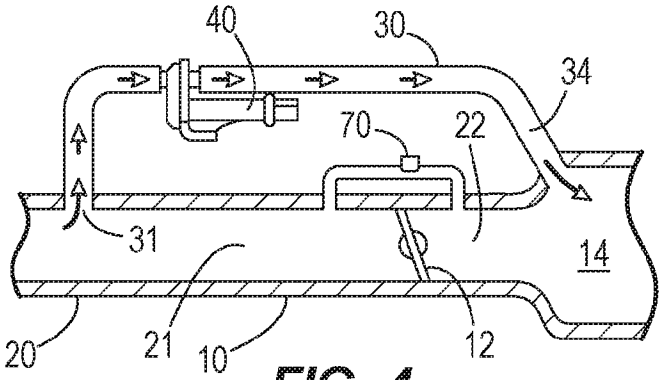
FIG. 4 PRIOR ART

FIG. 4 shows a type of idle air control valve that does not use an engine control module. One type uses a thermo-wax element to vary the amount of bypass the air flowing through the air conduit 30 as a function of the coolant temperature of the engine. Once the engine reaches operating temperature, the valve 34 is generally closed. A second type of idle air control system that does not use an engine control module uses a spring loaded gate balanced against a bi-metal element. As engine temperature rises, the bi-metal element deflects to close the gate valve thereby reducing the amount of bypass air. In FIG. 4, an idle speed adjustment screw 70 is also illustrated.

With reference to FIGS. 1-4, the typical idle air control systems exhibit certain common characteristics. They allow air to flow around a closed throttle plate 12 from a first region 21 upstream from the throttle plate 12 to a second region 22 downstream from the throttle plate 12. This bypass function is performed through the use of an air conduit 30 that allows air to flow from an inlet 31 near the first region 21 to an outlet 34 near the second region 22. A valve is used to regulate the flow through the air conduit 30. Under certain conditions, such as during initial engine startup, air is allowed to flow through the air conduit 30 for the purpose of bypassing a closed throttle plate 12.

The operation of the idle air control valve 40 and the passage of air through the air conduit 30 can cause excessive noise. In certain applications, particularly in certain marine propulsion system applications, this noise can decrease the enjoyment of using a marine vessel.

Figure 5:
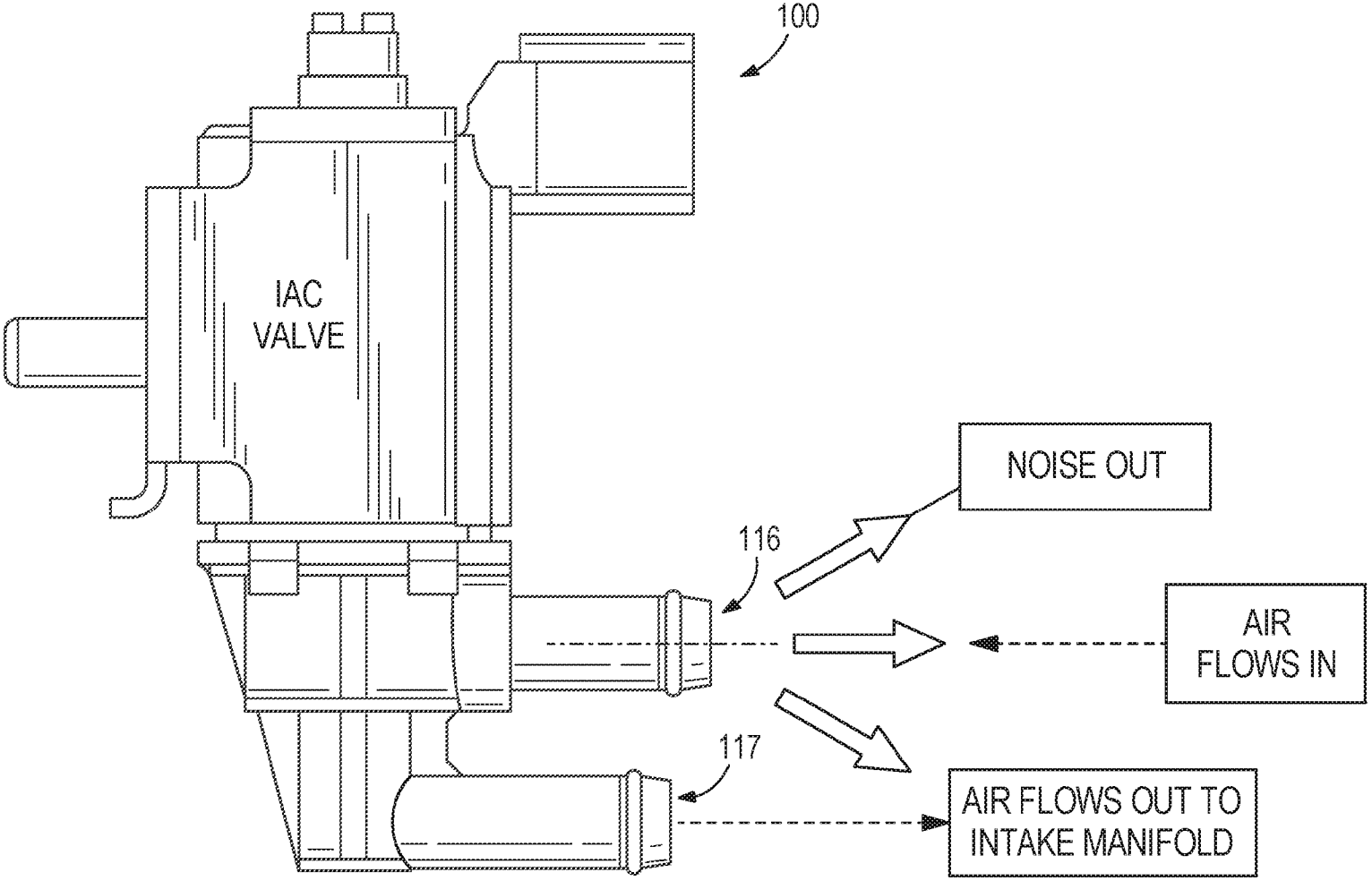
FIG. 5 depicts an exemplary idle air control valve.

FIG. 5 depicts an exemplary idle air control valve 100, which can be constructed according to any of the examples described herein above with respect to FIGS. 1-4. In accordance with the examples described herein above, the idle air control valve 100 is configured for fluid communication with the air conduit 30 and is configured to control rate of the air flow from the inlet 31 to the outlet 34.

Figure 6:
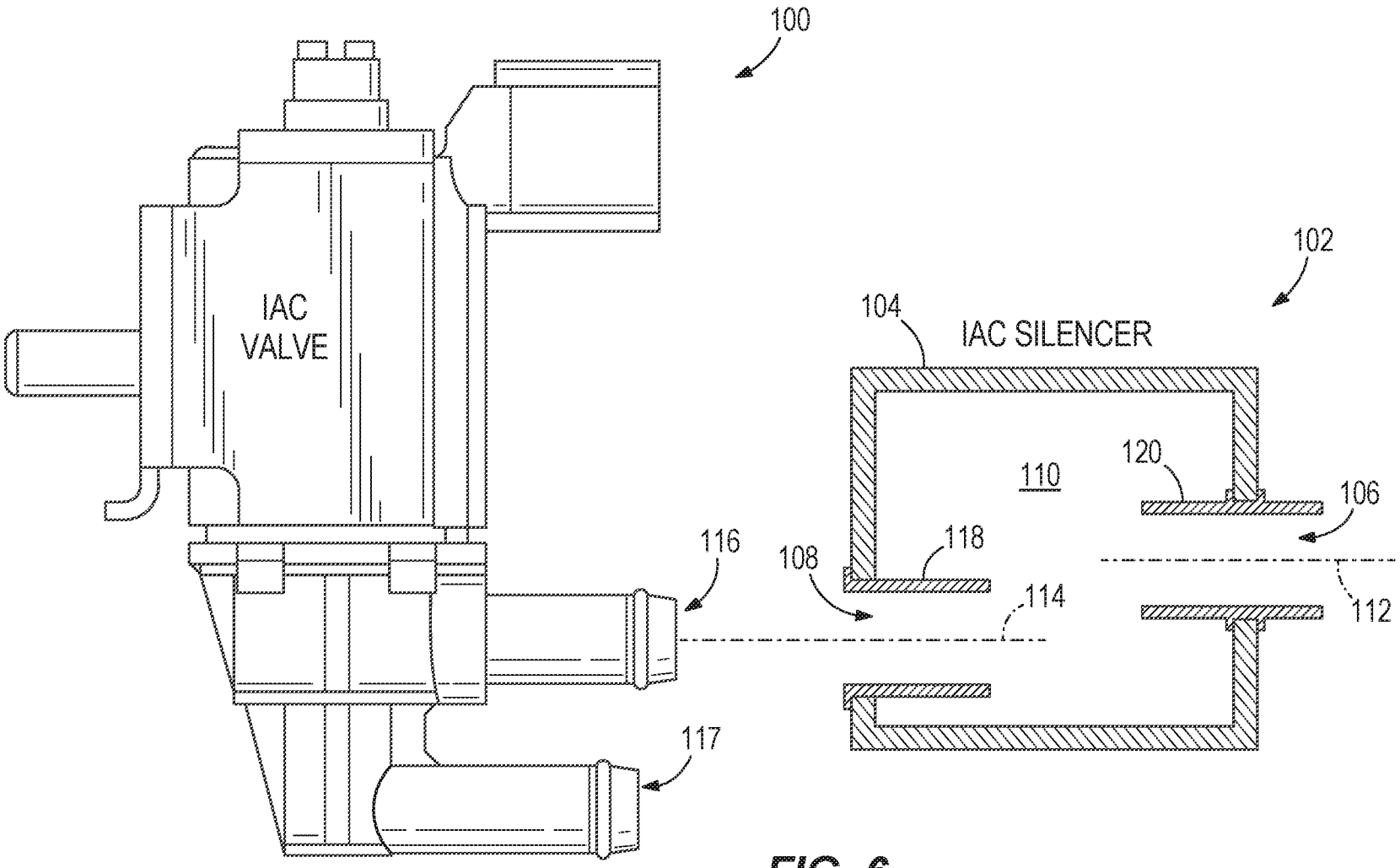
FIG. 6 is an exploded view of the idle air control valve and a noise cancelling device.
Figure 7:
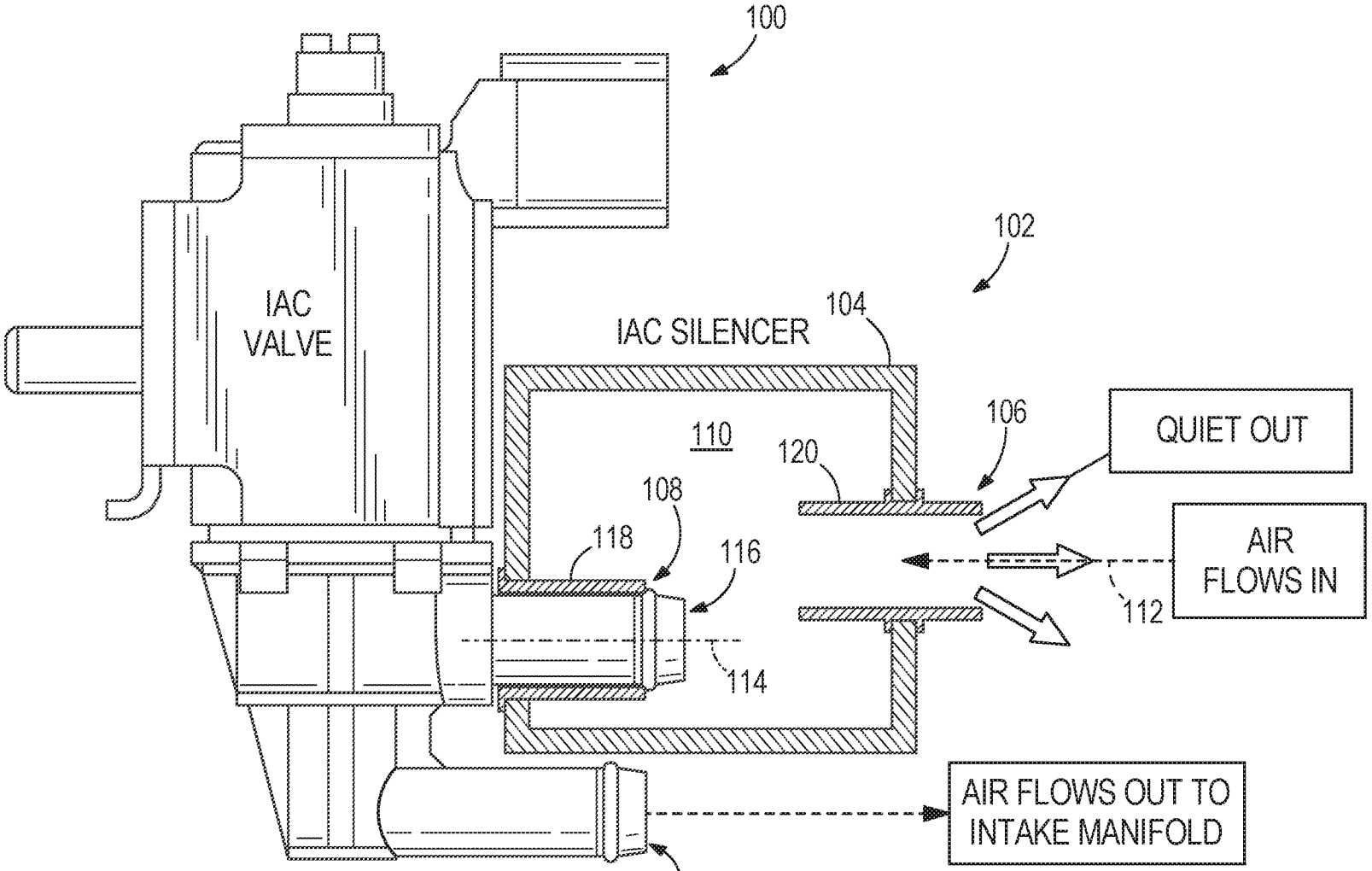
FIG. 7 is a view of the noise cancelling device mounted on the idle air control valve.

Referring to FIGS. 6 and 7, a noise cancelling device 102 according to the present disclosure is configured to receive airflow from the air conduit 30 and discharge the airflow to the idle air control valve 100. The noise cancelling device 102 includes a pass-through chamber 104 and has a chamber inlet 106 that receives the airflow from the air conduit 30, a chamber outlet 108 that discharges the airflow to the idle air control valve 100, and a pass-through interior 110 disposed between the chamber inlet 106 and chamber outlet 108. In the illustrated example, the pass-through interior 110 is a completely open interior and constitutes an expansion chamber for attenuating noise. The chamber inlet 106 extends along an inlet center axis 112. The chamber outlet 108 extends along an outlet center axis 114 that is parallel to the inlet center axis 112. The inlet center axis 112 and outlet center axis 114 are offset or radially spaced apart from each other.

Figure 9:
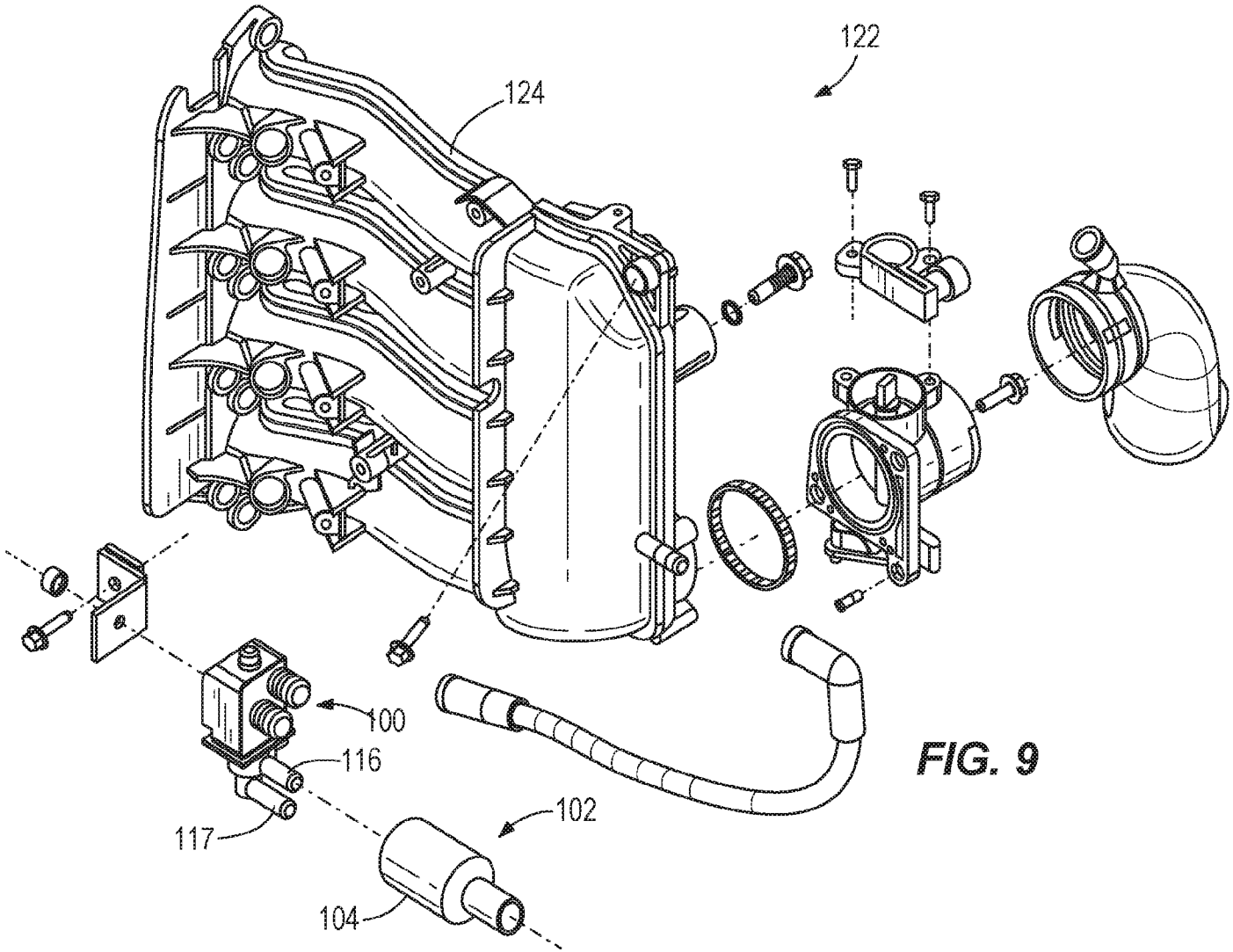
FIG. 9 is an exploded view of one example of an air intake system according to the present disclosure.

The idle air control valve 100 includes a valve inlet 116 that is configured to receive the airflow from the air conduit 30 via the noise cancelling device 102 and a valve outlet 117 that is configured to discharge the airflow to the exhaust manifold 124 (see FIG. 9). The chamber outlet 108 on the noise cancelling device 102 is configured to mate with the valve inlet 116. In the illustrated example, the chamber outlet 108 has an outlet sleeve 118 that is sized to mate with the valve inlet 116. The type of connection between the chamber outlet 108 and valve inlet 116 can vary and in the illustrated example includes a press fit. Radial seals can be added to provide an airtight connection. The chamber inlet 106 includes an inlet sleeve 120 that is sized to mate with a downstream end of the above-noted air conduit 30. Again, the type of connection can vary and in the illustrated example includes a press fit. Radial seals can be added to provide an airtight connection. As such, in the illustrated example, the noise cancelling device 102 is a modular device that can easily be attached to and removed from the system.

The noise cancelling device 102 is advantageously configured to cancel noise emanating from the upstream side of the idle air control valve 100. In certain examples, the noise cancelling device 102 can specifically be tuned (e.g. sized and shaped) to cancel the noise frequencies of the particular configuration of idle air control valve to which the noise cancelling device 102 is attached. The specific type of noise cancelling device 102 having a pass-through chamber 104 can vary from that which is shown and in other examples can include a differently sized/shaped expansion chamber than what is shown, a concentric chamber, hybrid chamber/absorber, and/or the like.

Figure 8:
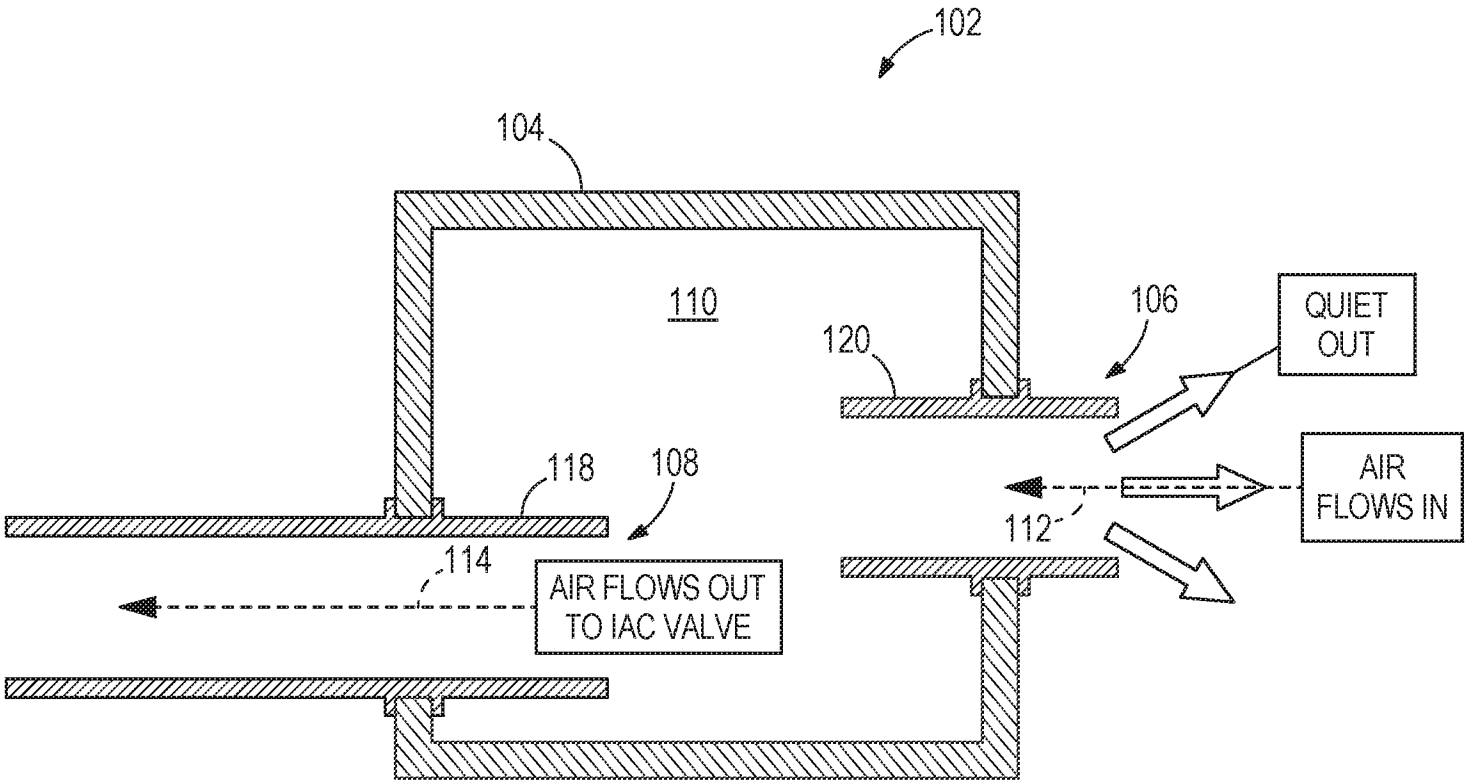
FIG. 8 is another example of the noise cancelling device and an elongated outlet sleeve for connection to the idle air control valve.

FIG. 8 is another example of the noise cancelling device 102 wherein the outlet sleeve 118 is elongated (as compared to the example in FIG. 7) and similarly configured for connection to the valve inlet 116. In this example, the noise cancelling device 102 and idle air control valve 100 are separated by a distance defined by the length of the outlet sleeve 118.

FIG. 9 is an exploded view of one example of an intake system 122 according to the present disclosure, including the idle air control valve 100, the noise cancelling device 102 and the exhaust manifold 124.

What is claimed is:

1. An air intake system for a marine engine, the air intake system comprising:

a throttle body;

a throttle plate that is rotatably supported within the throttle body, the throttle plate being rotatable to regulate air flow through the throttle body from a first region on a first side of the throttle plate to a second region on a second side of the throttle plate;

an air conduit that has an air conduit inlet and an air conduit outlet, the air conduit outlet being disposed in fluid communication with the second region, the air conduit inlet being disposed in fluid communication with a location which is at a pressure generally equal to pressure within the first region;

an idle air control valve connected in fluid communication with the air conduit and configured to control rate of the air flow from the inlet to the outlet; and a noise cancelling device comprising an expansion pass-though chamber, the expansion pass-through chamber having a chamber inlet that receives the air flow from the air conduit, a chamber outlet that discharges the air flow to the idle air control valve, and a walled pass-through interior disposed between the chamber inlet and chamber outlet and sized larger than the chamber inlet such that the walled, pass-though chamber causes noise emanating from the idle air control valve to expand and attenuate prior to emanating from the chamber inlet.

2. The air intake system according to claim 1, wherein the pass-though interior is a completely open interior.

3. The air intake system according to claim 1, wherein the chamber inlet extends along an inlet center axis and wherein the chamber outlet extends along an outlet center axis that is parallel to the inlet center axis.

4. The air intake system according to claim 3, wherein the inlet center axis and outlet center axis are radially spaced apart from each other.

5. The air intake system according to claim 4, wherein the idle air control valve comprises a valve inlet configured to receive the air flow from the air conduit and wherein the chamber outlet is configured to mate with the valve inlet.

6. The air intake system according to claim 5, wherein the chamber outlet comprises an outlet sleeve that is sized to mate with the valve inlet in a press-fit.

7. The air intake system according to claim 5, wherein the chamber inlet comprises an inlet sleeve that is sized to mate with a downstream end of the air conduit in a press-fit.

8. The air intake system according to claim 1, wherein the noise cancelling device is a modular device that can be attached to and removed from the system.

9. An air intake system for a marine engine, the air intake system comprising:

a throttle body;

a throttle plate that is rotatably supported within the throttle body, the throttle plate being rotatable to regulate air flow through the throttle body from a first region on a first side of the throttle plate to a second region on a second side of the throttle plate;

an air conduit that has an air conduit inlet and an air conduit outlet, the air conduit outlet being disposed in fluid communication with the second region, the air conduit inlet being disposed in fluid communication with a location which is at a pressure generally equal to pressure within the first region;

an idle air control valve connected in fluid communication with the air conduit and configured to control rate of the air flow from the inlet to the outlet; and a noise cancelling device comprising an expansion pass-though chamber, the expansion pass-through chamber having a chamber inlet that receives the air flow from the air conduit, a chamber outlet that discharges the air flow to the idle air control valve, and a walled pass-through interior disposed between the chamber inlet and chamber outlet and sized larger than the chamber inlet such that the walled pass-though chamber causes noise emanating from the idle air control valve to expand and attenuate prior to emanating from the chamber inlet;

wherein the chamber inlet extends along an inlet center axis and wherein the chamber outlet extends along an outlet center axis that is parallel to the inlet center axis;

wherein the inlet center axis and outlet center axis are radially spaced apart from each other;

wherein the idle air control valve comprises a valve inlet configured to receive the air flow from the air conduit and wherein the chamber outlet is configured to mate with the valve inlet; and wherein the noise cancelling device is a modular device that can be attached to and removed from the system.

10. An air intake system for a marine engine, the air intake system comprising:

a throttle body;

a throttle plate within the throttle body, the throttle plate being rotatable to regulate air flow through the throttle body from a first region on a first side of the throttle plate to a second region on a second side of the throttle plate;

an air conduit having an air conduit inlet and an air conduit outlet, the air conduit outlet being disposed in fluid communication with the second region, the air conduit inlet being disposed in fluid communication with a location which is at a pressure generally equal to pressure within the first region;

an idle air control valve connected in fluid communication with the air conduit and configured to control rate of the air flow from the inlet to the outlet, wherein the idle air control valve has a body with an idle air control valve inlet that conveys the air flow from the air conduit outlet into the body and an idle air control valve outlet that conveys the air flow out of the body to an intake manifold of the marine engine;

a noise cancelling device comprising a pass-through chamber that is coupled to the idle air control valve inlet, the noise cancelling device comprising an expansion pass-through chamber, the expansion pass-through chamber having a chamber inlet that receives the air flow from the air conduit outlet, a chamber outlet that discharges the air flow to the idle air control valve inlet, and a walled pass through interior disposed between the chamber inlet and the chamber outlet and sized larger than the chamber inlet such that the pass-through chamber causes noise emanating from the idle air control valve to expand and attenuate prior to emanating from the chamber inlet.

* * * * *